US007694967B2

(12) United States Patent
Denoual

(10) Patent No.: US 7,694,967 B2
(45) Date of Patent: Apr. 13, 2010

(54) DICE CUP

(76) Inventor: Thierry Denoual, 1000 Illinois St., San Francisco, CA (US) 94107

( * ) Notice: Subject to any disclaimer, the term of this patent is extended or adjusted under 35 U.S.C. 154(b) by 0 days.

(21) Appl. No.: 12/165,571

(22) Filed: Jun. 30, 2008

(65) Prior Publication Data

US 2009/0322023 A1 Dec. 31, 2009

(51) Int. Cl.
*A63F 9/04* (2006.01)

(52) U.S. Cl. ..... 273/145 A; 273/145 R; D21/372

(58) Field of Classification Search ..... 273/145 A, 273/145 R, 145 B, 145 C, 145 CA; D21/372, D21/373
See application file for complete search history.

(56) References Cited

U.S. PATENT DOCUMENTS 148,374 A 3/1874 Mains
1,781,983 A 11/1930 Mains
2,060,463 A * 11/1936 Gessler ..... 273/145 A
3,892,410 A 7/1975 Hoetzel
4,148,488 A 4/1979 Kohlhagen
4,533,143 A 8/1985 Albright
5,259,618 A 11/1993 Ramos
2008/0211181 A1 * 9/2008 Fedison ..... 273/145 A

FOREIGN PATENT DOCUMENTS

DE 3032363 A * 3/1982

* cited by examiner

*Primary Examiner*—Benjamin H Layno
(74) *Attorney, Agent, or Firm*—Craig M. Stainbrook; Stainbrook & Stainbrook, LLP

(57) ABSTRACT

A dice cup for use in dice games involving concealment of the dice, including an open top end and an open bottom end, a closed opaque wall extending therebetween, and a longitudinal axis. A plurality of spaced-apart slats are disposed across the bottom end so as to define a plurality of viewing holes. The slats prevent dice from being ejected from the cup when said cup is shaken with said top end covered, and when the cup is inverted to cover dice on a flat surface, the slats provide an impediment to seeing the dice through the viewing holes unless viewed at a sufficiently small angle relative to said longitudinal axis.

14 Claims, 3 Drawing Sheets

DICE CUP

SEQUENCE LISTING

Not applicable.

CROSS REFERENCES TO RELATED APPLICATIONS

Not applicable. The present application is an original and first-filed United States Utility patent application with no claim to priority of an earlier filed patent application.

STATEMENT REGARDING FEDERALLY SPONSORED RESEARCH OR DEVELOPMENT

Not applicable.

THE NAMES OR PARTIES TO A JOINT RESEARCH AGREEMENT

Not applicable.

INCORPORATION-BY-REFERENCE OF MATERIAL SUBMITTED ON A COMPACT DISC

Not applicable.

BACKGROUND OF THE INVENTION

1. Field of the Invention

The present invention relates generally to cups for throwing dice in dice games, and more particularly to dice cups adapted for use in Liar's Dice or variants thereof, and still more particularly to a dice cup with a see through bottom that conceals the results of the dice throw to all but the cup holder.

2. Discussion of Related Art Including Information Disclosed Under 37 CFR §§ 61.97, 1.98:

A turn in a game of chance is often commenced by throwing or rolling one or more dice. When the die are rolled, the score used in the turn of play is almost invariably the value or values showing on the uppermost face of the dice after they come to rest. In a game of pure chance, it is imperative that the dice roll randomly without any control exercised over the outcome by the person rolling or throwing the dice. In consequence, immediately before the throw the dice or die are blindly shaken and allowed to rotate and change position freely. To minimize the influence by the thrower, rather than using bare hands, the dice may first be shaken in a dice cup, and then rolled from the cup or clapped down onto a table surface to bring the dice to rest.

Some dice games involve concealing the dice after a roll. The most well known among such games is Liar's Dice (known as Call my Bluff or Perudo in the commercial versions). The game originated in South America and has become a popular gambling or drinking game in the United States. It goes by the name of Dudo or Cachito in South America, though the South American variants are typically called Mexicali or Mexican in the United States.

There are several versions of Liar's Dice, the most important being "individual hand," "common hand," and "Mexican", mentioned above. All variations involve two or more players, the use of five six-sided dice, a dice cup, and then use of the dice cup to conceal the dice after each roll. When the dice come to rest, the thrower tips the cup, looks at the result, and commences the bidding process. Subsequent bids and bets are made about the result of the roll based on the credibility of the opening bid and the successor bids. Thus, while the dice remain concealed, players must either raise a bid or challenge the bid in turn. As noted, the concealment is generally effected by tipping the cup only slightly, such that only the thrower can see the dice trapped under the cup. However, cheating is common (nearly encouraged), and the player throwing the dice often cup their hands around the base of the cup as it is tipped to more fully conceal the dice.

The number of dice and dice cups differs according the game variation played. In the "common hand" variation, each player is provided with a set of dice; the players each roll one dice and conceal the throw from the other players. Bids are made by each player based on the dice he/she sees plus a prediction of all the dice concealed dice (namely, the dice thrown by all the other players). In the "individual hand" variation, at each turn one set of dice is passed from one player to the next. Bids are made according to the dice as they are in front of the bidder after selected dice have been re-rolled. Both the common hand and individual hand variations use a set of five six-sided dice. In the variant known as Mexican Liar's Dice, only three dice are used.

However, in each variation, and in each round of play, the roll of the dice and the progression of bidding takes place with the dice concealed from all players other than the thrower. Typically, the bidding begins with the dice thrower openly stating the minimum number of a chosen face showing on the dice rolled (one "4" for instance"). The statement may be a an accurate description of the roll, or it may be an outright lie. Thus, the name Liar's Dice comes from the practice of responsive bids, which can include calling the first bidder a "liar" by challenging the bid and forcing him/her to lift the cup to reveal the dice and show whether the bid was valid. In such a case, if the same number or more of the chosen face number are revealed, then the bid is considered successful, and the throwing player wins. Otherwise the challenger wins.

As would be expected, numerous dice cups have been styled for particular dice games, either because the cup fits the physical needs of the game or because of other design constraints that dictate a certain design. Backgammon dice cups, for instance, tend to be oval in shape and have a relatively thin profile. Such a shape is driven by the need to fit the dice up in the case typically used for the backgammon game. Interestingly, no special design has been proposed for use in playing Liar's dice, and the kind of cup employed in Liar's Dice is merely the classically styled leather or vinyl cup having a generally cylindrical shape, a bottom bumper, and bull lips. Occasionally the interior of the cup is provided with a soft material to dampen the sound of the rattling dice. The classic cups require the thrower to tip the cup to view the dice.

It would be desirable if the ritual of tipping the cup to view the dice could be entirely eliminated. This would free the thrower's hands to attend to other matters (handling a drink, for instance), and it would also free him from having to lean closely down to see the dice under the ever-so-slightly tipped cup. This would focus more attention on his or her face, and the lying would have to be more skillful and convincing. A dice cup with a restricted viewing window might accomplish such an objective.

Dice caps with windows for viewing a dice roll have been devised. For instance, dice cups with transparent walls are shown in each of U.S. Pat. Nos. 148,374 to Mains; 1,781,983 to Koch; and 3,892,410 to Hoetzel.

In addition, U.S. Pat. No. 4,533,143 to Albright et al teaches a lottery number selector including buoyant cubes contained in a fluid tight and generally opaque container. The container has a window for viewing a predetermined number of the cubes temporarily trapped and arranged adjacent the window after agitating the container by a user. A cube receiving channel is formed within the container adjacent the window for releasably trapping a desired number of cubes adjacent the window.

In a variation on the Albright invention, U.S. Pat. No. 4,148,488 to Kohlhagen describes a sealed cube with six transparent windows, in which is disposed a second cube having six number bearing faces, each in register with and in relatively close proximity to a corresponding face of the first cube. An optical shielding liquid within the container fills the container so that when the die is at rest a transparent bubble is formed between an upper, horizontally disposed insignia bearing face and the container face in registration with the upper face. The shielding liquid obscures all of the other number bearing faces. In this manner, only the uppermost face of the inner cube can be seen.

U.S. Pat. No. 5,259,618 to Ramos teaches a lockable, tamper proof dice cup for use in games of chance, which includes a transparent cylindrical wall attached to a receiver base to form a chamber for containing dice. A locking mechanism comprising a tamper proof set screw with an end engaging the cylindrical wall captures the dice within the chamber and prevents unauthorized removal of the wall from the base. Dice, however, can be seen from all sides of the wall.

The foregoing patents reflect the current state of the art of which the present inventor is aware. Reference to, and discussion of, these patents is intended to aid in discharging Applicant's acknowledged duty of candor in disclosing information that may be relevant to the examination of claims to the present invention. However, it is respectfully submitted that none of the above-indicated patents disclose, teach, suggest, show, or otherwise render obvious, either singly or when considered in combination, the invention described and claimed herein. Specifically, none teach or show a dice cup that provides means for selectively viewing the results of the dice throw without having to tip the dice cup; more particularly, the foregoing patents do not teach or describe a dice cup with means for the dice thrower to view the results of a dice roll by looking at the dice through a viewing window while also preventing others from viewing the dice.

BRIEF SUMMARY OF THE INVENTION

The present invention is a dice cup adapted for betting and gambling games in which concealment of the dice plays an important role.

It is therefore an object of the present invention to provide a new and improved dice cup having a bottom configured for allowing the user to view the results of a roll of the dice while preventing others from seeing the same results.

It is another object of the present invention to provide a new and improved dice cup for Liar's Dice having an open bottom viewing window.

An even further object of the present invention is to provide a novel dice cup that obviates the need to tip the dice cup or otherwise remove it from rolled dice in order to view the results of the roll.

The foregoing summary broadly sets out the more important features of the present invention so that the detailed description that follows may be better understood, and so that the present contributions to the art may be better appreciated. There are additional features of the invention that will be described in the detailed description of the preferred embodiments of the invention which will form the subject matter of the claims appended hereto.

Accordingly, before explaining the preferred embodiment of the disclosure in detail, it is to be understood that the disclosure is not limited in its application to the details of the construction and the arrangements set forth in the following description or illustrated in the drawings. The inventive apparatus described herein is capable of other embodiments and of being practiced and carried out in various ways.

Also, it is to be understood that the terminology and phraseology employed herein are for descriptive purposes only, and not limitation. Where specific dimensional and material specifications have been included or omitted from the specification or the claims, or both, it is to be understood that the same are not to be incorporated into the appended claims.

As such, those skilled in the art will appreciate that the conception, upon which this disclosure is based may readily be used as a basis for designing other structures, methods, and systems for carrying out the several purposes of the present invention. It is important, therefore, that the claims are regarded as including such equivalent constructions as far as they do not depart from the spirit and scope of the present invention. Rather, the fundamental aspects of the invention, along with the various features and structures that characterize the invention, are pointed out with particularity in the claims annexed to and forming a part of this disclosure. For a better understanding of the present invention, its advantages and the specific objects attained by its uses, reference should be made to the accompanying drawings and descriptive matter in which there are illustrated the preferred embodiment.

BRIEF DESCRIPTION OF THE SEVERAL VIEWS OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1A:
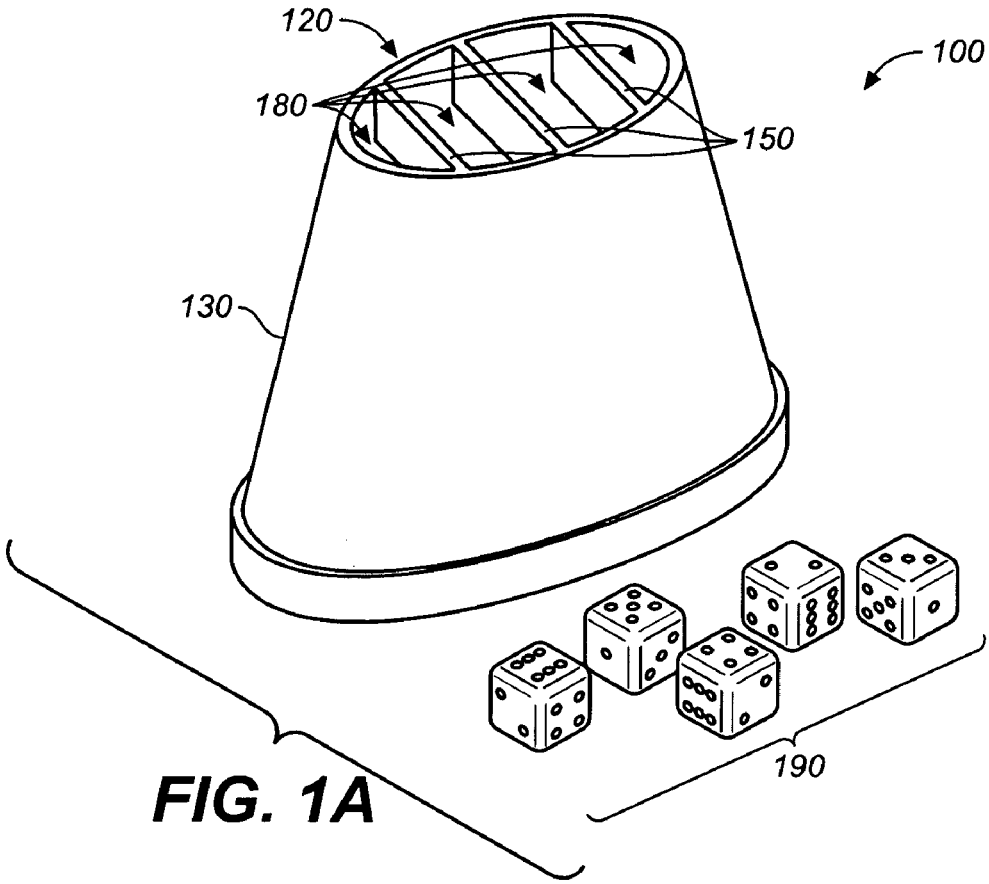
FIG. 1A is a lower perspective front view of the dice cup of the present invention, shown with a plurality of dice at its side.
Figure 1B:
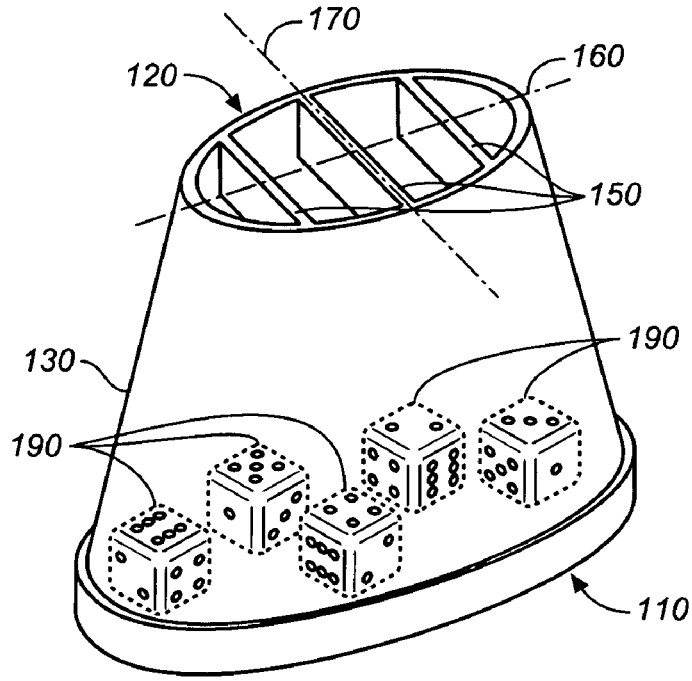
FIG. 1B is a lower perspective front view thereof, showing the dice contained within the dice cup.
Figure 3:
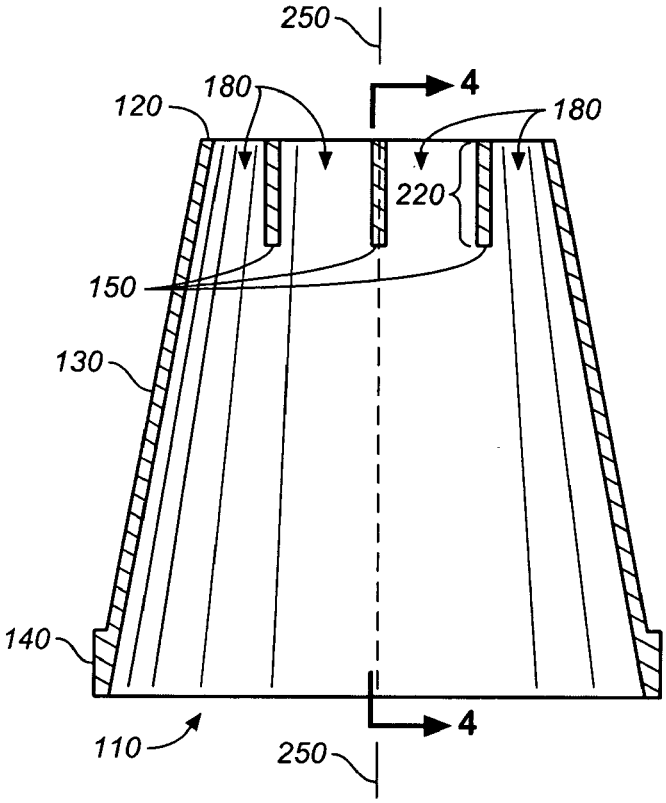
FIG. 3 is a cross-sectional front view in elevation taken along section line 3-3 of FIG. 4.
Figure 4:
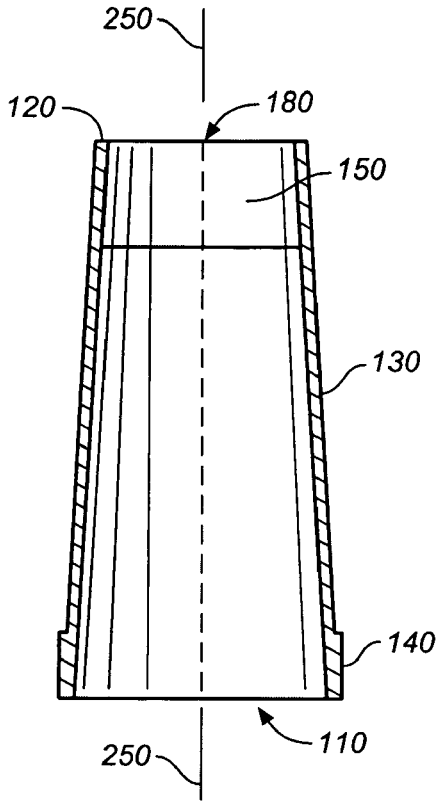
FIG. 4 is a cross-sectional side view in elevation thereof.
Figure 2:
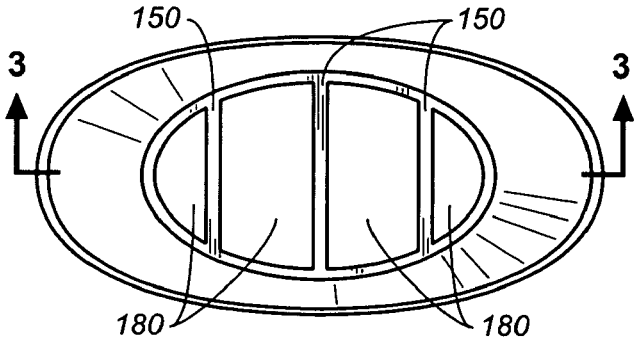
FIG. 2 is a top plan view of the inventive dice cup.
Figure 5:
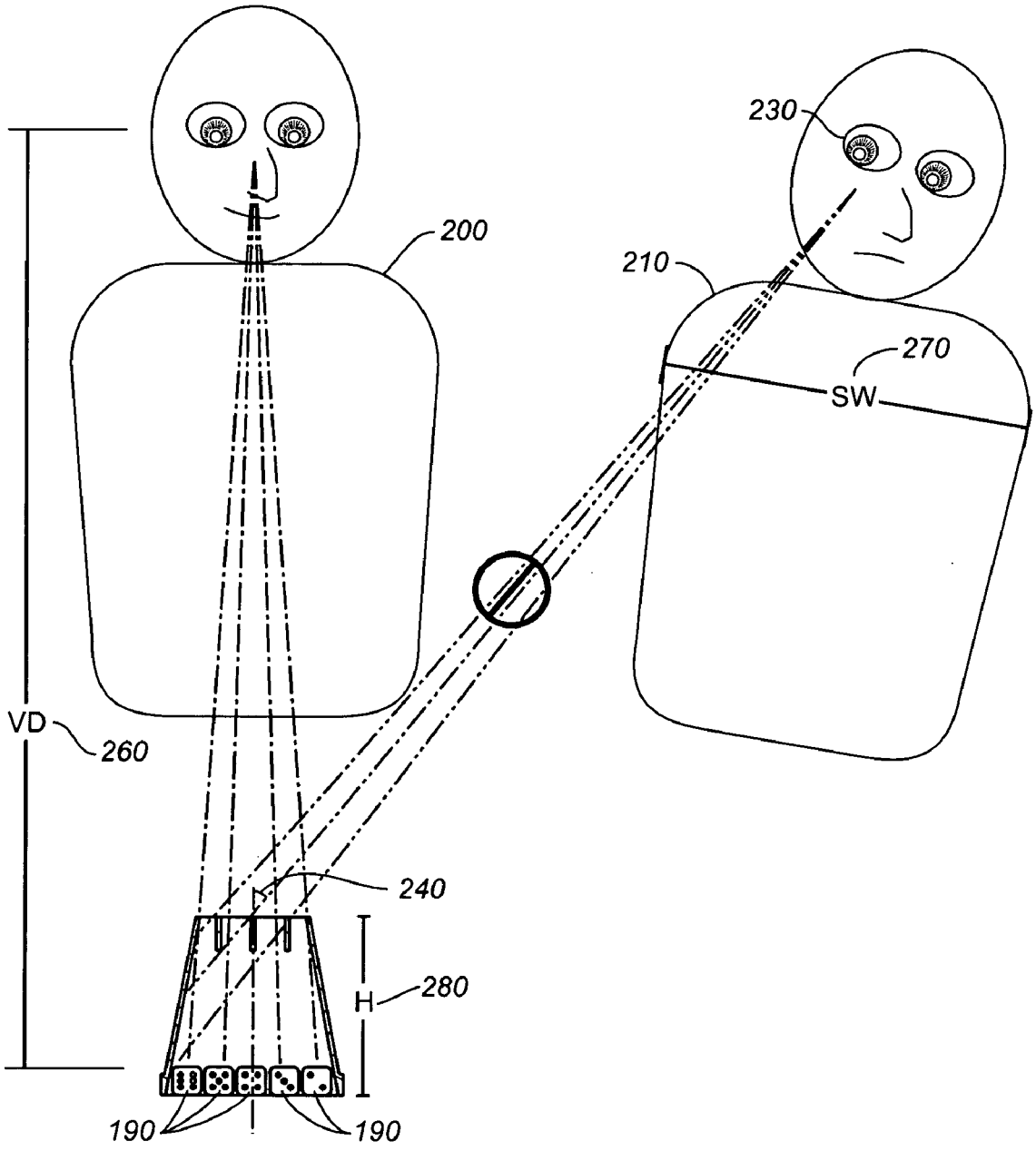
FIG. 5 is a schematic view showing how the inventive dice cup defines and confines the viewing field so that only the dice user can see the faces showing on the dice covered by the inventive dice cup.

Referring to FIGS. 1A through 5, wherein like reference numerals refer to like components in the various views, there is illustrated therein a new and improved dice cup, generally denominated 100 herein. These views show a preferred embodiment of the inventive dice cup, which comprises a generally elliptical open top end 110, a generally elliptical open bottom end 120, and a closed opaque wall 130 extending between the top and bottom ends. An optional upper end reinforcing rim 140 may be provided to facilitate handling and for ornamental purposes. Most importantly, the open bottom end of the dice cup includes a plurality of generally parallel slats 150 disposed across the opening to provide a screen or impediment to viewing the dice through the open end when viewed at a sufficiently large angle to the side of the cup. The slats may be parallel to either the major axis 160 or the minor axis 170 of the elliptical bottom end, and the parallel slats define a plurality of openings or viewing holes 180 for viewing the dice 190. Preferably, the ratio of the lengths of the major and minor axes of the top and bottom ends are the same or substantially the same. This creates an even and aesthetically pleasing tapering of the sides.

The critical dimensions for effective use of the inventive cup relate to the slats and the openings they define. This is because the slats not only define the openings 180 for viewing the dice 190, they also keep the dice from coming out from the cup when only one hand is used by the throwing player 200 to shake the cup (that hand being used to cover the top opening, and they prevent a second player 210 from seeing the dice when that player is separated a sufficient (typical) distance from the cup. Specifically, in order to provide the dice-capturing function while also providing adequate light and a sufficiently unobstructed view for the dice thrower, the slats must be spaced to define openings narrower than the width of the sides of the dice used, and the width 220 of the slats must be sufficient to impede the view of the nearby player.

It has been found empirically that in most playing environments the eyes 230 of the nearby player are typically positioned at least 30 degrees 240 off the longitudinal axis 250 of the cup. Further, the cuboid dice used in typical dice games are between 12 mm and 20 mm on each cube edge, the most common size being 16 mm (approximately 0.63 inches). A rough maximum height 260 for the viewing distance VD for viewing the dice from a position directly above the dice is 400 mm (approximately 15.7 inches). The average shoulder width SW 270 for adults is between 400 mm and 660 mm (approximately 16 to 26 inches). Thus, to ensure that the non-throwing player cannot see the dice, in a typical playing environment (when using dice 16 mm on edge), the slats must be spaced no greater than the width of the dice, the slats must themselves have a width greater than 16 mm (6.3 inches), though 20 mm is a preferred width when the cup has a preferred height h 280 of approximately greater than four (4) times the edge dimension of the dice, and the length of the major axis 160 of the bottom opening is also preferably at least four (4) times the edge dimension of the dice. The specific dimensions of the slat spacing may be altered according to the size of the dice employed. In such an event the various other dimensions of the cup are changed proportionally to avoid compromising the concealment function of the cup. Of all the elements, the width 220 of the slats is the one variable that can be easily adjusted in accordance with changes to any of the other cup dimensions. Thus, if the size of the bottom opening is made significantly larger, and if the height of the cup is made significantly smaller, then the width of the slats can be proportionately varied to prohibit side viewing of dice from an angle of greater than 30 degrees relative to the longitudinal axis of the cup. Accordingly, a number of suitable combinations of cup dimensions may be reasonably employed, as long as the width dimension of the slats is sufficient to provide the optimal shielding for the playing environment and for the dice selected for use. Also, it will be appreciated that the thickness of the slats may be selected for both aesthetic and structural reasons and will be governed, in part, by the need to have sufficient strength to withstand repeated collisions with dice when the cup is shaken and repeated rapid decelerations of the cup as it is slammed down on a table or counter top. The material chosen for the slats will obviously have a bearing on the required thickness.

It will therefore be appreciated that the inventive dice cup, in its most essential aspect, is adapted for use in a dice game in which the dice are placed in the cup, shaken by a player, thrown onto a surface while simultaneously being covered by the inverted cup, and then concealed from a competitor while a round of betting ensues. The cup essentially includes a top end and a bottom end and a wall extending between the ends so as to define an enclosure, with or without openings at each end (the top end, for instance, could include a selectively openable door). The cup further includes a viewing window disposed in the bottom end so that the player throwing the dice can view the dice through the window after covering them with the cup. At the same time, the competitor is prevented from viewing the dice at a predetermined angle, preferably when the angle is greater than 30 degrees of the longitudinal axis of the cup. The window preferably comprises a plurality of slats disposed across the bottom end so as to form a plurality of viewing holes, and the slats define the angle from which a view of the dice is obstructed or prevented.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like. For instance, slats 150 may be disposed in a generally parallel orientation, as illustrated, or they may be arrayed in a grid or other polygonal patterns, and so forth. As long as the slats include a barrier to viewing the dice from an angle above the dice cup, the possibilities for a slat pattern are manifold.

Therefore, the foregoing description and illustrations should not be construed as limiting the scope of the invention, which is defined by the appended claims.

What is claimed is:

1. A dice cup for use in dice games involving concealment of the dice, comprising:

a tubular cup member having an open top end and an open bottom end, a closed opaque wall extending therebetween, and a longitudinal axis;

a plurality of spaced-apart slats disposed across said open bottom end so as to define a plurality of viewing holes;

wherein said slats prevent dice from being ejected from said cup when said cup is shaken with said top end covered, and wherein when said cup is inverted to cover dice on a flat surface said slats provide an impediment to seeing the dice through said bottom end unless viewed at a sufficiently small angle relative to said longitudinal axis.

2. The dice cup of claim 1, wherein said slats are disposed in a generally parallel configuration.

3. The dice cup of claim 1, wherein said slats are disposed in a grid pattern.

4. The dice cup of claim 1, wherein said slats are disposed in a polygonal pattern.

5. The dice cup of claim 1, wherein said open bottom end is elliptically shaped and includes a major axis and a minor axis.

6. The dice cup of claim 5, wherein said slats are parallel to said major axis.

7. The dice cup of claim 5, wherein said slats are parallel to said minor axis.

8. The dice cup of claim 1, wherein said bottom end and said top end are elliptically shaped and each include a major and minor axis.

9. The dice cup of claim 8, wherein the ratio of the lengths of the major and minor axes of said top and bottom ends are substantially the same.

10. The dice cup of claim 1, wherein when said cup is inverted to cover dice on a flat surface said slats provide an impediment to seeing the dice through said bottom end unless viewed at an angle less than 30 degrees relative to said longitudinal axis.

11. A dice cup for use in a dice game, wherein the game involves shaking the dice by a player, throwing the dice by clapping the dice cup down onto a surface, and thereafter concealing the dice from a competitor for a portion of the player's turn, said cup comprising:

a top end;

a bottom end;

a wall extending between said top end and said bottom end and defining an enclosure;

a longitudinal axis;

an opening for placing dice into said cup;

a viewing window comprising a plurality of slats disposed across said bottom end so as to form a plurality of viewing holes in said bottom end for viewing dice, wherein when said cup is inverted to cover dice on a flat surface, said slats provide an impediment to seeing the dice through said bottom end unless viewed at a sufficiently small angle relative to said longitudinal axis.

12. The dice cup of claim 11, wherein said slats are disposed in a generally parallel configuration.

13. The dice cup of claim 11, wherein said slats are disposed in a grid pattern.

14. The dice cup of claim 11, wherein said slats are disposed in a polygonal pattern.

* * * * *